US009310126B2

(12) United States Patent
Yi et al.

(10) Patent No.: US 9,310,126 B2
(45) Date of Patent: Apr. 12, 2016

(54) REFRIGERATOR

(71) Applicant: LG ELECTRONICS INC., Seoul (KR)

(72) Inventors: Myeongha Yi, Seoul (KR); Taegyeong Kim, Seoul (KR); Ayoung Choo, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 14/674,394

(22) Filed: Mar. 31, 2015

(65) Prior Publication Data

US 2015/0300726 A1 Oct. 22, 2015

(30) Foreign Application Priority Data

Apr. 18, 2014 (KR) ..... 10-2014-0046778

(51) Int. Cl.
*A47B 96/04* (2006.01)
*F25D 23/06* (2006.01)
*F25D 25/02* (2006.01)

(52) U.S. Cl.
CPC ..... *F25D 23/069* (2013.01); *F25D 23/062* (2013.01); *F25D 23/067* (2013.01); *F25D 25/02* (2013.01)

(58) Field of Classification Search
CPC ..... F25D 25/02
USPC ..... 126/337 A, 337 R, 339; 62/382; 312/228.1; 108/106
See application file for complete search history.

(56) References Cited

U.S. PATENT DOCUMENTS 2,486,564 A * 11/1949 Kamin ..... F24C 15/162 126/339
2,998,290 A * 8/1961 Sharpe ..... F25D 25/02 312/303
3,316,044 A 4/1967 Carbary
3,666,342 A 5/1972 Biesecker (Continued)

FOREIGN PATENT DOCUMENTS

CN 102494508 A 6/2012
EP 1 621 838 A2 2/2006

(Continued)

OTHER PUBLICATIONS

European Search Report dated Sep. 8, 2015 issued in Application No. 151630506.6.

(Continued)

*Primary Examiner* — Matthew Ing
(74) *Attorney, Agent, or Firm* — KED & Associates, LLP

(57) ABSTRACT

A refrigerator includes a cabinet with a storage chamber, and a shelf assembly. The shelf assembly includes guide members respectively mounted to opposite side walls of the storage chamber, a shelf vertically movable while being guided by the guide members, side walls extending downwards from opposite lateral ends of the shelf and vertically movable while being guided by the guide members, guide slots formed through the guide members while extending in forward and rearward directions, a pair of cam members pivotably mounted to an outer surface of each guide member, first and second links connected between the cam members, to simultaneously pivot the cam members, a handle link connected, at one end thereof, to the second link, and a handle member coupled to the other end of the handle link while extending through the corresponding guide slot, to protrude inside the guide member.

20 Claims, 6 Drawing Sheets

(56) References Cited

U.S. PATENT DOCUMENTS

| | | | | |
|---|---|---|---|---|
| 3,809,450 | A * | 5/1974 | Guth | A47L 15/504 312/351 |
| 8,297,726 | B2 | 10/2012 | Ramm et al. | |
| 8,376,482 | B2 * | 2/2013 | An | F25D 25/02 312/408 |
| 8,911,042 | B2 * | 12/2014 | Bassi | F25D 25/02 312/223.6 |
| 2005/0062380 | A1 | 3/2005 | Park et al. | |
| 2005/0179351 | A1 * | 8/2005 | Bassi | A47B 57/20 312/408 |
| 2009/0058247 | A1 * | 3/2009 | Collins | F25D 25/02 312/408 |
| 2011/0031863 | A1 | 2/2011 | Benitsch et al. | |
| 2013/0081421 | A1 * | 4/2013 | Kwon | F25D 23/04 62/440 |
| 2013/0193828 | A1 * | 8/2013 | Bassi | F25D 25/02 312/408 |
| 2015/0076985 | A1 | 3/2015 | Yoo et al. | |

FOREIGN PATENT DOCUMENTS

| | | | |
|---|---|---|---|
| JP | 2002-174487 | A | 6/2002 |
| JP | 2002-264943 | A | 9/2002 |
| JP | 2004-298218 | A | 10/2004 |
| KR | 10-2006-0040290 | A | 5/2006 |
| KR | 10-2009-0129076 | A | 12/2009 |
| KR | 10-1035144 | B1 | 5/2011 |
| KR | 20-0468206 | B1 | 8/2013 |
| WO | WO 2013-041679 | A2 | 3/2013 |

OTHER PUBLICATIONS

European Search Report dated Sep. 30, 2015 issued in Application No. 15163436.7.

United States Notice of Allowance dated Oct. 8, 2015 issued in U.S. Appl. No. 14/660,675.

* cited by examiner

REFRIGERATOR

CROSS-REFERENCE TO RELATED APPLICATION

This application claims priority under 35 U.S.C. §119 to Korean Patent Application No. 10-2014-0046778, filed on Apr. 18, 2014, whose entire disclosure is hereby incorporated by reference.

BACKGROUND

1. Field

The present disclosure relates to a refrigerator, and more particularly, to a refrigerator capable of easily moving a shelf mounted to a storage chamber without separation of the shelf.

2. Background

Generally, a refrigerator is an appliance for storing food, etc. within a storage chamber in a frozen or refrigerated state by discharging, into the storage chamber, cold air generated through a refrigeration cycle constituted by a compressor, a condenser, an expansion valve, an evaporator, etc. Such a refrigerator generally includes a freezing compartment for storing food or beverages in a frozen state, and a refrigerating compartment for storing food or beverages at low temperature. A Kimchi refrigerator, which stores food such as Kimchi or vegetables in a fresh state, is another form of refrigerator.

At least one of plural doors installed at a refrigerator is connected to one side of a body by a hinge, to open or close a front side of the body through pivotal movement thereof. In addition to such a door, which pivots about a hinge, a drawer type door may also be employed. The drawer type door includes a drawer, and a door mounted to a front side of the drawer, to be withdrawn or retracted in a forward or rearward direction, together with the drawer.

Storage compartments of a refrigerator such as freezing and refrigerating compartments, are provided with a plurality of shelves to vertically divide the freezing and refrigerating compartments into sections, in order to store food articles having various sizes and to enhance space utilization. Since food articles to be placed on such shelves may have various sizes, the shelves are separably mounted at different levels in the freezing and refrigerating compartments while being movable to adjust mounting levels thereof.

Mounting of the shelves may be achieved by slidably mounting the shelves to a plurality of support ribs formed at left and right surfaces of the refrigerating and freezing compartments, or coupling a pair of cantilevers coupled to each shelf, and then mounting the cantilevers to mounting rails each formed with a plurality of vertically arranged holes.

In accordance with such prior art, however, level adjustment of shelves may be difficult and troublesome because, when it is desired to adjust mounting level of a shelf, the user has to separate the shelf from the support ribs or mounting rails after completely removing food articles from the shelf, and then to mount the separated shelf to another level.

In this regard, the applicant proposed a structure capable of adjusting the level of a shelf while food is placed thereon, as disclosed in Korean Unexamined Patent Publication No. 10-2006-0040290. However, the disclosed structure has a problem in that, when it is desired to adjust the level of a shelf, the user has to move the shelf along an inclined guide slot in forward and rearward directions by a long distance. Furthermore, the shelf should be moved between an initial position and a final position by a considerable distance. There may be also a danger in that, when the shelf is used under a condition that the shelf is disposed at an upper position thereof, and food articles are placed on the shelf, the shelf may be moved to a lower position thereof along the guide slot.

The above references are incorporated by reference herein where appropriate for appropriate teachings of additional or alternative details, features and/or technical background.

BRIEF DESCRIPTION OF THE DRAWINGS

The embodiments will be described in detail with reference to the following drawings in which like reference numerals refer to like elements wherein.

DETAILED DESCRIPTION

Figure 1:
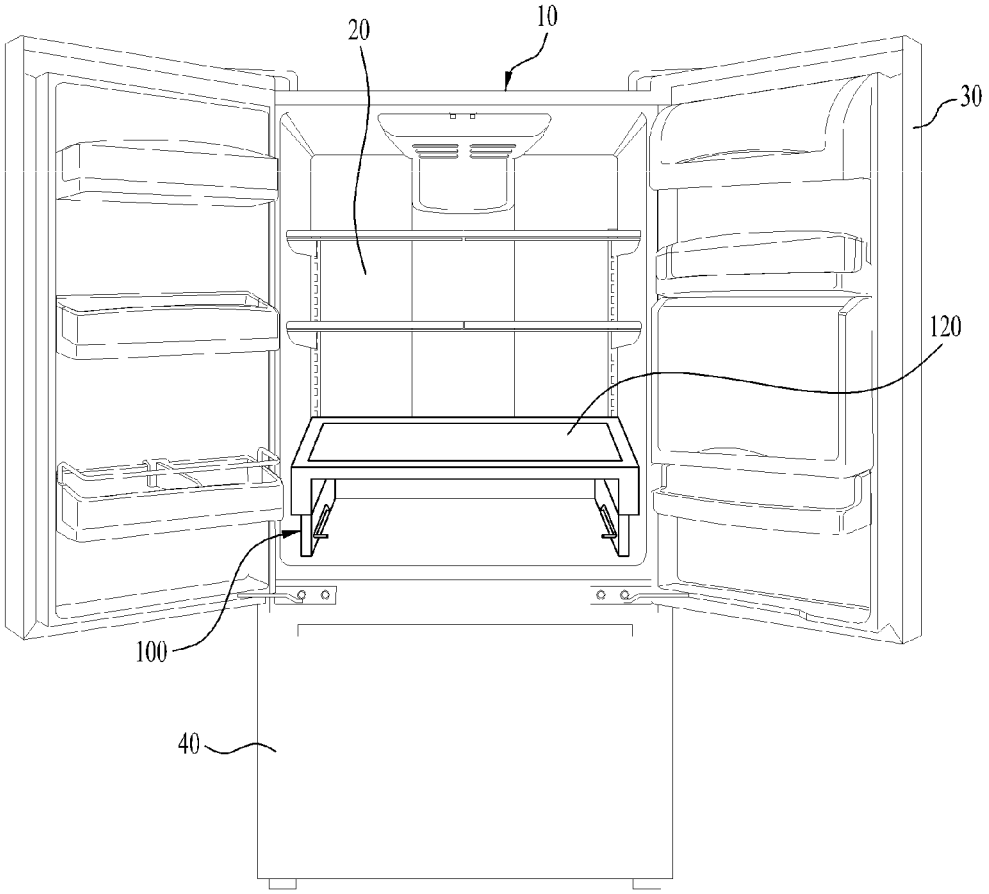
FIG. 1 is a perspective view illustrating a bottom freezer type refrigerator equipped with a shelf assembly in accordance with the present disclosure.

FIG. 1 is a perspective view illustrating a bottom freezer type refrigerator equipped with a shelf assembly in accordance with the present disclosure. The refrigerator according to the present disclosure includes a cabinet 10 defined with a storage chamber therein, and a shelf assembly 100 mounted in the storage chamber, to be vertically movable.

The illustrated refrigerator is a bottom freezer type refrigerator in which a refrigerating compartment 20 is provided at a top side of the cabinet 10, and a freezing compartment is provided at a bottom side of the cabinet 10. The present disclosure may also be applied to refrigerators of other types, so long as the shelf assembly 100 is mountable in a storage chamber such as a refrigerating compartment or a freezing compartment.

Refrigerators of other types include a side-by-side type refrigerator in which a freezing compartment and a refrigerating compartment are laterally arranged, and a top mounting type refrigerator in which a freezing compartment is arranged over a refrigerating compartment. In addition, the present disclosure may be applied to a refrigerator including a refrigerating compartment or a freezing compartment alone, so long as the shelf assembly 100 is mountable in the storage chamber.

The shelf assembly 100 may mainly be mounted in a refrigerating compartment, but may be mounted to a freezing compartment. In the following description, the storage chamber may mean a refrigerating compartment or a freezing compartment. In this regard, the shelf assembly 100 of the present disclosure may be mounted in a refrigerating compartment or a freezing compartment.

The refrigerating compartment 20 provided at the top side of the cabinet 10 may be opened or closed by a pair of pivotally-mounted refrigerating compartment doors 30. The freezing compartment provided at the bottom side of the cabinet 10 may be opened or closed by a freezing compartment door 40, which is a drawer type door. Of course, the freezing compartment door 40 may be a pivotally-mounted door, in place of the drawer type door.

The shelf assembly 100 may mainly be mounted in a lower portion of the refrigerating compartment 20, and may include a vertically movable shelf. The shelf assembly 100 may further include at least one shelf separably mounted on the shelf assembly 100. As illustrated in FIG. 1, the shelf mounted on the shelf assembly 100 may be supported by cantilevers. Otherwise, this shelf may be supported by shelf support ribs.

Figure 2:
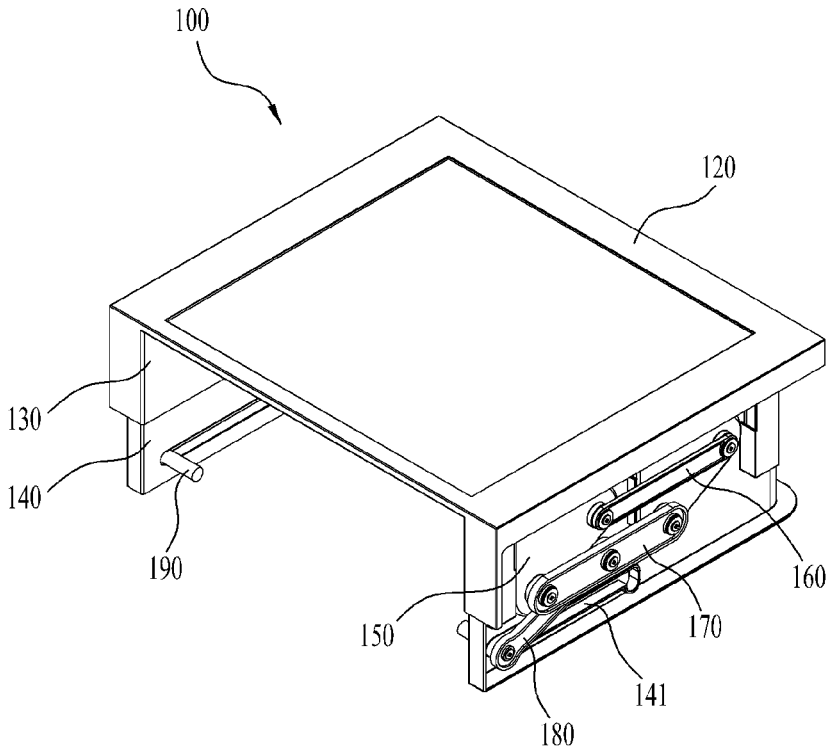
FIG. 2 is a perspective view illustrating a shelf assembly according to a preferred embodiment of the present disclosure.
Figure 3:
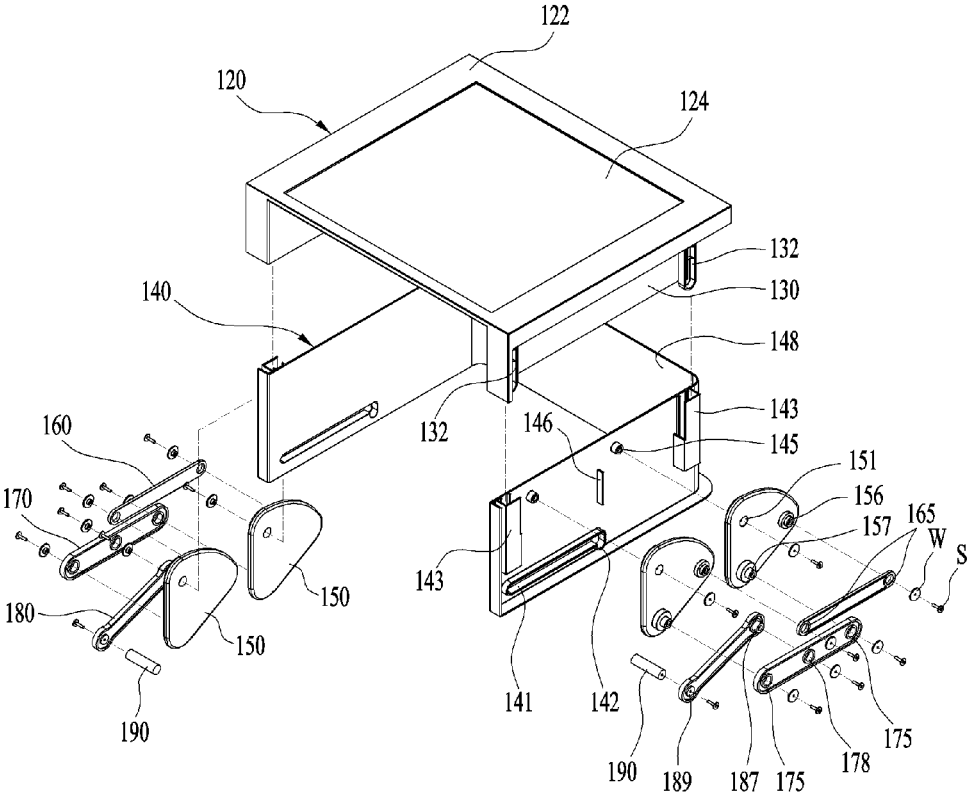
FIG. 3 is an exploded perspective view illustrating an exploded state of the shelf assembly illustrated in FIG. 2.

FIG. 2 is a perspective view illustrating a shelf assembly according to a preferred embodiment of the present disclosure. FIG. 3 is an exploded perspective view illustrating an exploded state of the shelf assembly illustrated in FIG. 2.

The shelf assembly 100 according to the illustrated embodiment of the present disclosure may include guide members 140 respectively mounted to opposite side walls of the storage chamber, a shelf 120 vertically movable while being guided by the guide members 140, side walls 130 extending downwards from opposite lateral ends of the shelf 120 and vertically movable while being guided by the guide members 140, respectively, and guide slots 141 respectively formed through the guide members 140 while extending in forward and rearward directions.

The shelf assembly 100 may also include a pair of cam members 150 pivotably mounted to an outer surface of each guide member 140. Each cam member 150 has three pivotal axes at different positions, to vertically move the shelf 120. The shelf assembly 100 may further include first and second links 160 and 170 connected between the cam members 150, to be pivotable with respect to the cam members 150, a handle link 180 connected, at one end thereof, to the second link 170, and a handle member 190 coupled to the other end of the handle link 180 while extending through the corresponding guide slot 141, to protrude inside the corresponding guide member 140. The handle member 190 is movable along the guide slot 141 in accordance with guidance of the guide slot 141 while being supported by the guide slot 141.

Each guide member 140 has a plate shape having a predetermined thickness. Each guide member 140 may be fastened to opposite side walls of the refrigerating compartment 20 by fasteners such as screws, to be mounted to the refrigerating compartment 20. When a rear wall 148 is provided to be integrated with the guide members 140, as will be described later, the guide members 140 may be seated on the bottom of the refrigerating compartment 20. Each guide member 140 may mainly be molded, using a plastic material. A plurality of reinforcing ribs are formed at an outer surface of each guide member 140 and, as such, the guide member 140 may have sufficient support strength while having a relatively small thickness.

The shelf 120 is supported by the guide members 140, to be vertically slidable. The shelf 120 may have a flat plate shape, and may include the pair of side walls 130, which extend downwards from opposite lateral ends of the shelf 120 and are vertically movable while being guided by the guide members 140, respectively. The side walls 130 may be symmetrically formed. The side walls 130 may be disposed to be slidable while contacting inner surfaces of the guide members 140, respectively.

When guide ribs 132 provided at respective side walls 130 of the shelf 120 are fitted in guide grooves 143 provided at respective guide members 140, to be slidably supported by the guide grooves 143, as will be described later, the side walls 130 may be disposed to be slightly spaced from respective inner surfaces of the guide members 140.

As illustrated in FIG. 3, the guide slots 141 may be formed through respective lower portions of the guide members 140, to extend in forward and rearward directions. The handle member 190, which is connected to the handle link 180, is laterally inserted into the corresponding guide slot 141, to be slidably guided by the guide slot 141, and, as such, is supported by a front or rear end of the guide slot 141, as will be described later.

A pair of cam members 150 may be pivotably mounted to an outer surface of each guide member 140. Two cam members 150 may be mounted to the outer surface of the right guide member 140, and two cam members 150 may be mounted to the outer surface of the left guide member 140. A pair of pivotal pins 145 having a boss structure may be provided at an upper portion of the outer surface of each guide member 140, to pivotally mount the corresponding cam members 140 to the guide member 140.

Corresponding to each pivotal pin 145, a pivotal pin hole 151 having a through hole structure may be provided at one side of an upper portion of the corresponding cam member 150. The cam member 150 may be pivotably mounted to the corresponding guide member 140 through fastening of a screw S under the condition that a washer W is interposed between the pivotal pin 145 and the pivotal pin hole 151.

Each of the cam members 150 pivotally mounted to each guide member 140 is further provided with two pivotal pin holes at different positions than the pivotal pin hole 151 and, as such, the cam members 150 may vertically move the shelf 120 while simultaneously pivoting by a plurality of links connected thereto. The cam members 150 have the same structure and are mounted to front and rear portions of the outer surface of the corresponding guide member 140 at the same level. Accordingly, the cam members 150 may simultaneously pivot to vertically move the shelf 120.

One first link 160 and one second link 170 are connected between the cam members 150 on each guide member 140, to pivot with respect to each other, and, as such, the cam members 150 may pivot while having the same pivotal angle and the same pivotal movement height. Each cam member 150 may generally have a fan shape, and may be round at angular points of the fan shape.

An arc portion of the fan shape in each cam member 150 contacts a lower surface of the shelf 120, to support the shelf 120. Since two angular points at opposite sides of the arc portion in the cam member 150 are round, the cam member 150 may smoothly vertically move the shelf 120. Since the angular point opposite to the arc portion in each cam member 150 is also round, it may be possible to prevent the cam member 150 from interfering with other members while increasing a pivotal angle during pivotal movement thereof.

In each cam member 150, the pivotal pin hole 151 is disposed adjacent to one of the two angular points disposed near the arc portion, among the three angular points. Each cam member 150 is also provided with a first connecting pin 156 disposed adjacent to the other of the two angular points disposed near the arc portion, and a second connecting pin 157 disposed adjacent to the angular point opposite to the arc portion.

The first link 160 is formed with end connecting holes 165 at opposite ends thereof, respectively, to be connected between the first connecting pins 156 of the corresponding cam members 150. The second link 170 is formed with end connecting holes 175 at opposite ends thereof, respectively, to be connected between the second connecting pins 157 of the corresponding cam members 150.

Each of the first and second connecting pins 156 and 157 may take the form of a boss protruding from an outer surface of the corresponding cam member 150 and, as such, it may be possible to couple the corresponding cam members 150, to be pivotable with respect to each other, by fitting the first and second links 160 and 170 around the first and second connecting pins 156 and 157, and fastening screws S under the condition that washers W are interposed. The first and second connecting pins 156 and 157 may be formed to have a stepped structure in order to space the first and second links 160 and 170 from the outer surfaces of the cam members 150.

A handle connecting hole 178 is formed through an intermediate portion of the second link 170. The handle link 180 may be pivotably connected to the handle connecting hole 178. A link connecting pin 187 having a boss structure is formed at one end of the handle link 180, to protrude laterally. The link connecting pin 187 is fitted in the handle connecting hole 178 and, as such, the handle link 180 may be pivotably coupled to the handle connecting hole 178 through fastening of a screw and use of a washer.

The handle member 190 is fastened to the other end of the handle link 180 by a screw, to protrude inside the corresponding guide member 140 while extending through the corresponding guide slot 141. The handle member 190 is movable along the guide slot 141 in accordance with guidance of the guide slot 141 while being supported by the guide slot 141. The user may vertically move the shelf 120 via the handle link 180, second link 170, and cam members 150 by moving the handle member 190.

Referring to FIG. 3, it may be seen that the second link 170 is greater than the first link 160, and the second connecting pin 157 is greater than the first connecting pin 156. Connected to the handle link 180 supported by the handle member 190 is the second link 170. The corresponding cam members 157 are substantially supported by the second link 170, which is supported by the handle link 180.

The first link 160 and second link 170 are connected to simultaneously pivot the corresponding cam members 157 through the same pivotal angle. Relatively small force is applied to the first link 160, as compared to the second link 170.

Accordingly, the second link 170 is preferably formed to be greater than the first link 160 because the second link 170 should bear greater force and have greater support strength.

Each guide slot 141 includes a support groove 142 formed at a rear end of the guide slot 141 while having a lower level than the remaining portion of the guide slot 141, to support the corresponding handle member 190 in order to retain a raised position of the shelf 120. The support groove 142 may stably support the shelf 120 when the shelf 120 is positioned at a raised position thereof, in order to prevent the shelf 120 from easily falling due to carelessness of the user. Each guide member 140 may include a pair of stopper ribs 146 to support the corresponding cam members 150, respectively, when the shelf 120 is positioned at the lowered position thereof.

Figure 5:
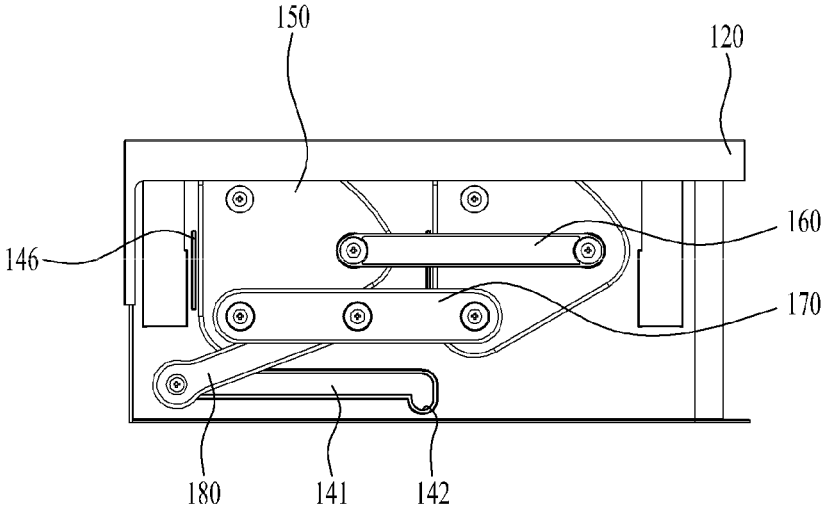
FIG. 5 is a right side view illustrating a right side of the shelf assembly illustrated in FIG. 2.

As illustrated in FIG. 5, each cam member 150 may be disposed such that one side surface of the cam member 150 is vertically arranged when the shelf 120 is positioned at the lowered position thereof. In this regard, each stopper rib 146 may take the form of a vertically elongated rib, to support the vertical side surface of the corresponding cam member 150.

When each stopper rib 146 supports one side surface of the corresponding cam member 150, the corresponding handle member 190 may be supported by the front end of the corresponding guide slot 141. In this case, accordingly, when the shelf 120 is positioned at the lowered position thereof, the front end of each guide slot 141 supports the corresponding handle member 190 connected to the corresponding handle member 180, and each stopper rib 146 supports the corresponding cam member 150. Thus, the shelf 120 may be stably supported.

Although not shown, each guide slot 141 may further include at least one intermediate groove having a lower level than the remaining portion of the guide slot 141, to retain the shelf 120 at an intermediate level. When one intermediate groove is provided, the shelf 120 may be moved to three levels, namely, raised, intermediate and lowered levels, and may then be retained at a selected one of the three levels. When two intermediate groove are provided, the shelf 120 may be moved to four levels, namely, a raised level, two intermediate levels and a lowered level, and may then be retained at a selected one of the four levels.

When such an intermediate groove is provided, the corresponding handle member 190 is temporarily engaged in the intermediate groove, and is then moved to a next level when the user pushes the handle member 190 or pulls the handle member 190 while lifting the handle member 190. By the provision of such intermediate grooves, it may be possible to subdivide a level, at which the shelf 120 is retained, and to reduce impact applied to the shelf 120 when the shelf 120 is vertically moved at once.

As illustrated in FIG. 3, the shelf 140 may include a pair of side walls mounted in the storage chamber, to guide vertical movement of the shelf 120, and a rear wall 148 connecting rear ends of the side walls. When each guide member 140 include a side wall alone, the guide members 140 should be fastened to the side walls of the refrigerating compartment 20 by separate fasteners, to be fixed to the side walls of the refrigerating compartment 20.

When the side walls of the guide members 140 are connected at rear ends thereof by the rear wall 148, it is unnecessary to fix the guide members 140 to the side walls of the refrigerating compartment 20, using separate fastening members. In this case, the guide members 140 may be simply seated on the bottom of the refrigerating compartment 20.

In addition, each guide member 140 may include one vertical guide groove 143 formed at an outer surface of the guide member 140. In this case, the shelf 120 may include two guide ribs 132 extending downwards from the lower surface of the shelf 120. Each guide rib 132 is fitted in the vertical guide groove 143 of the corresponding guide member 140, to be vertically slidable.

Two pairs of guide grooves 143 may be provided at front and rear ends of the side walls of the guide members 140, respectively. Each guide groove 143 may have an upwardly opened rectangular parallelepiped shape, and may be open at upper portions of facing front and rear surfaces thereof.

Each guide rib 132 is slidably fitted in the corresponding guide groove 143. A pair of guide ribs 132 may be formed at positions corresponding to the guide grooves 143, respectively, to extend downwards from the lower surface of the shelf.

The guide ribs 132 do not protrude from respective side walls 130 of the shelf 120, but preferably extend downwards from the lower surface of the shelf 120.

That is, each guide rib 132 is preferably spaced from the outer surface of the corresponding side wall 130 by a predetermined distance.

Accordingly, each guide member 140 may be fitted between the corresponding side wall 130 and the corresponding guide rib 132. It is unnecessary to form a through hole for the guide rib 132 at the guide member 140 and, as such, it may be possible to prevent the guide member 140 from interfering with other elements or articles. In addition, a smart appearance is provided when the guide members 140 are installed in the refrigerating compartment 20 because the guide ribs 132 are hidden.

The shelf 120 may include a peripheral portion 122 made of a plastic material, and a shelf portion 124 made of a transparent plastic material or a glass material. The peripheral portion 122 may be injection-molded together with the side walls 130 and guide ribs 132, to form an integrated structure.

The shelf portion 124 may be fabricated, using a plate made of a transparent plastic material or a glass material, and may be mounted or attached to the inside of the peripheral portion 122, to enable articles received beneath the shelf portion 124 to be visible through the shelf portion 124. When the shelf portion 124 is made of glass, reinforced glass having high strength and high hardness may be used to prevent the shelf portion 124 from being easily broken or scratched.

Figure 4:
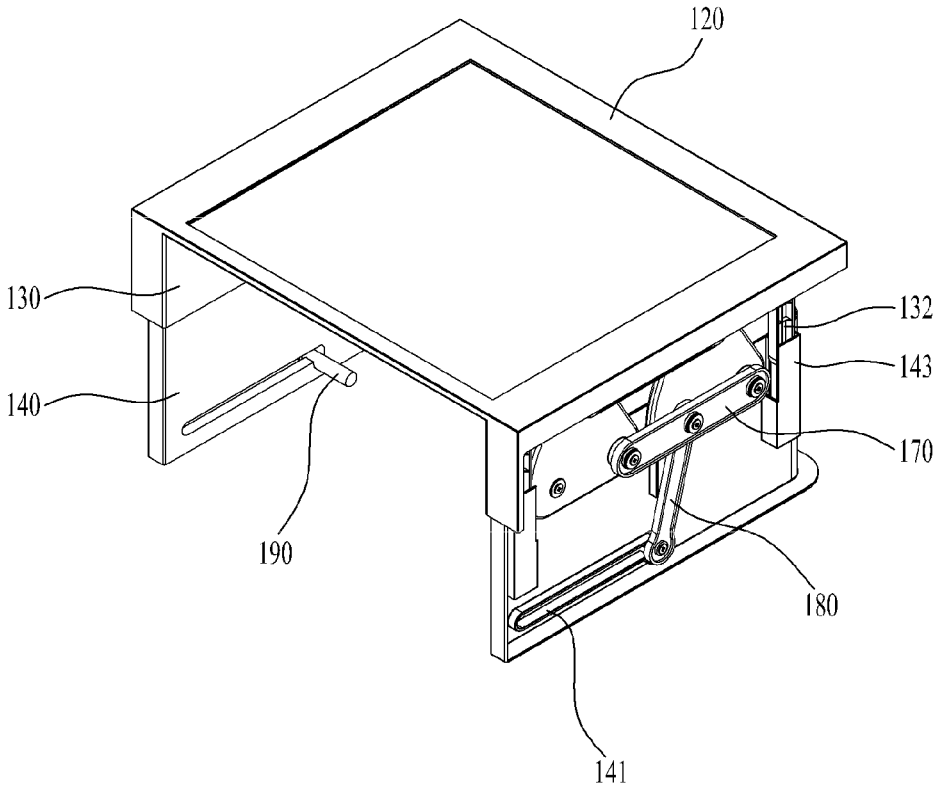
FIG. 4 is a perspective view illustrating a raised state of a shelf in the shelf assembly of FIG. 2.
Figure 6:
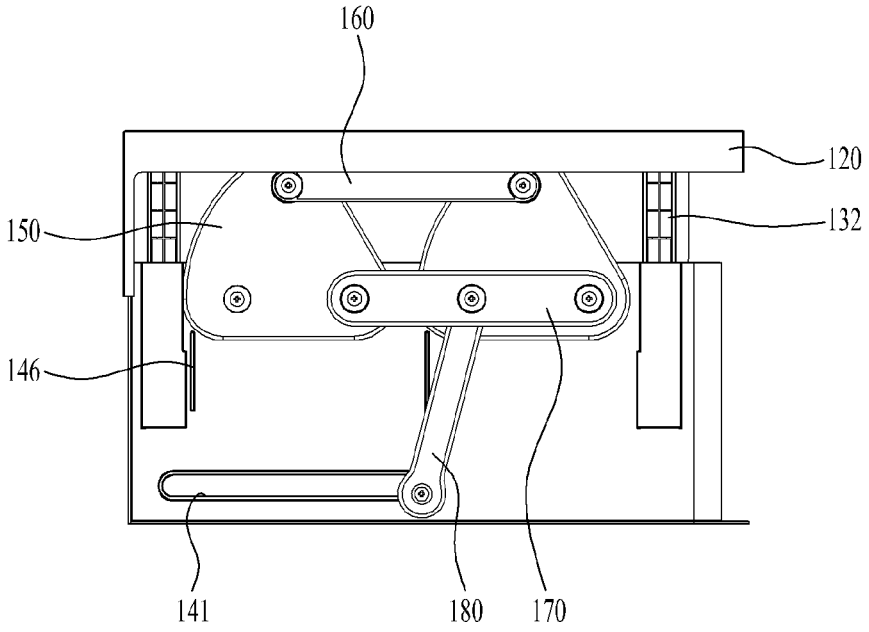
FIG. 6 is a right side view illustrating a raised state of the shelf in the shelf assembly of FIG. 5.

Operation of the shelf assembly will be described with reference to FIGS. 2, 4, 5, and 6. FIGS. 2 and 5 illustrate a state in which the shelf is positioned at the lowered position thereof. FIGS. 4 and 6 illustrate a state in which the shelf is positioned at the raised position thereof.

As illustrated in FIG. 2, when the user pushes the handle members 190 rearwards while grasping the handle members 190 by both hands under the condition that the shelf 120 is positioned at the lowered position thereof, the handle link 180 connected to each handle member 190 pushes the corresponding second link 170.

The cam members 150 connected to the second link 170 pivot upwards by the second link 170, and the first link 160 connected between the cam members 150 pivots simultaneously with the second link 170 and cam members 150. When each handle member 190 reaches a rearmost end of the corresponding guide slot 141, the handle member 190 naturally falls into the support groove 142 of the guide slot 141 by gravity and, as such, is supported by the support groove 142. The shelf 120 is raised to a maximally raised level, and then retained at a slightly lowered level. The state in which the shelf 120 is positioned at the raised position thereof in accordance with the above-described operation is illustrated in FIG. 6.

As apparent from the above description, it may be possible to easily vertically move the shelf even in a state in which articles are placed on the shelf and, as such, the space of the storage chamber may be very efficiently utilized.

A refrigerator may have a simple structure capable of easily achieving level adjustment of a shelf. A refrigerator may have a shelf assembly operating structure capable of simultaneously vertically moving left and right sides of a shelf while maintaining the shelf in a horizontal state. A refrigerator may have a safety device capable of preventing a shelf from unintentionally moving from an upper position to a lower position.

A refrigerator may include a cabinet defined with a storage chamber therein, and a shelf assembly mounted in the storage chamber, to be vertically movable, wherein the shelf assembly includes guide members respectively mounted to opposite side walls of the storage chamber, a shelf vertically movable while being guided by the guide members, side walls extending downwards from opposite lateral ends of the shelf and vertically movable while being guided by the guide members, respectively, guide slots respectively formed through the guide members while extending in forward and rearward directions, a pair of cam members pivotably mounted to an outer surface of each guide member, the cam members pivoting to vertically move the shelf, first and second links connected between the cam members, to simultaneously pivot the cam members, a handle link connected, at one end thereof, to the second link, and a handle member coupled to the other end of the handle link while extending through a corresponding one of the guide slots, to protrude inside the guide member.

Each of the cam members may have a fan shape. Angular points of the fan shape may be round. Each of the guide slots may include a support groove provided at a rear end of the guide slot while having a lower level than a remaining portion of the guide slot, to support a corresponding one of the handle members in order retain a raised position of the shelf. Each of the guide members may include a pair of stopper ribs to support the cam members corresponding to the guide member, when the shelf is positioned a lowered position thereof. Each of the guide slots may further include at least one intermediate groove having a lower level than a remaining portion of the guide slot, to retain the shelf at an intermediate level.

The guide members may include a pair of side walls mounted in the storage chamber, to guide vertical movement of the shelf, and a rear wall connecting rear ends of the pair of side walls. Each of the guide members may include a vertical guide groove formed at the outer surface of the guide member. The shelf may include a guide rib extending downwards from a lower surface of the shelf, the guide rib being fitted in the vertical guide groove, to be vertically slidable. The guide rib may be spaced from an outer surface of a corresponding one of the side walls in the shelf by a predetermined distance. The shelf may include a peripheral portion, and a shelf portion mounted to the peripheral portion inside the peripheral portion and made of a transparent material.

The refrigerator may be easily manufactured because the structure for adjusting the level of the shelf is simple. In addition, user convenience is increased because the operating mechanism for level adjustment of the shelf is simple.

Furthermore, there is little or no formation of a dead space for allowing movement of the shelf because positions of the shelf in forward and rearward directions in raised and lowered states of the shelf are the same. In addition, it may be possible to prevent the shelf from unintentionally falling during use thereof under the condition that the shelf is positioned at a raised position.

A refrigerator of the present disclosure may comprise a cabinet having a storage chamber therein; and at least one movable shelf configured to move vertically and provided in the storage chamber. The movable shelf includes at least one flat panel, first and second lateral walls extending vertically from ends of the at least one flat panel, first and second guide members configured to be coupled to in the storage chamber, the first guide member coupled to a first side wall of the storage chamber and a second guide member coupled to a second side wall of the storage chamber, the first and second lateral walls configured to be guided in vertical movement by the first and second guide members, respectively, a first guide slot provided on the first guide member and extending in a horizontal direction, a pair of first cam members configured to pivot over a first side surface of the first guide member to move the flat panel vertically, at least one first coupling link to link the pair of first cam members to allow simultaneous pivoting of the pair of first cam members, a first movable link coupled to the at least one coupling link, wherein when one end of the first movable link is move in a horizontal direction along the first guide slot, the flat panel is raised in a vertical direction based on pivot rotation of the pair of first cam members. The first side surfaces of the first and second guide members may be outer surfaces facing first and second walls of the storage chamber, and first and second walls being opposing walls facing each other.

The movable shelf may further comprise a pair of second cam members configured to pivot over a first surface of the second guide member, at least one second coupling link to link the pair of second cam members. a second guide slot provided on the second guide member and extending in a horizontal direction; and a second movable link having a second end configured to move in a horizontal direction along the second guide slot. The movable shelf further comprises at least one handle provided on at least one of first end of the first movable link or the second end of the second movable link, the at least one handle extending through at least one of the first guide slot or the second guide slot.

Each camber member of the pairs of first and second cam members has a dwell angle of substantially 90 degrees. when the flat panel is in a raised position, a rounded corner of each of the first and second cam members support the flat panel.

Any reference in this specification to "one embodiment," "an embodiment," "example embodiment," etc., means that a particular feature, structure, or characteristic described in connection with the embodiment is included in at least one embodiment of the disclosure. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A refrigerator comprising:

a cabinet defined with a storage chamber therein; and a shelf assembly mounted in the storage chamber, to be vertically movable, wherein the shelf assembly includes guide members respectively mounted to opposite side walls of the storage chamber, a shelf vertically movable while being guided by the guide members, side walls extending downwards from opposite lateral ends of the shelf and vertically movable while being guided by the guide members, respectively, guide slots respectively formed through the guide members while extending in forward and rearward directions, a pair of cam members pivotably mounted to an outer surface of each guide member, the cam members pivoting to vertically move the shelf, first and second links connected between the pair of the cam members, to simultaneously pivot the cam members, a handle link connected, at one end thereof, to the second link, and a handle member coupled to the other end of the handle link while extending through a corresponding one of the guide slots, to protrude inside the guide member.

2. The refrigerator according to claim 1, wherein:

each of the cam members has a fan shape; and angular points of the fan shape are round.

3. The refrigerator according to claim 2, wherein each of the cam members comprises:

a pivotal pin hole provided adjacent to one angular point of the fan shape disposed near an arc portion of the fan shape, and mounted to a pivotal pin provided at an outer surface of the guide member;

a first connecting pin provided adjacent to another angular point of the fan shape disposed near the arc portion, and connected to the first link; and a second connecting pin provided adjacent to another angular point of the fan shape opposite to the arc portion, and connected to the second link.

4. The refrigerator according to claim 3, wherein:

the second link is mounted at a lower level than the first link; and the first link and the second link are maintained in parallel when the cam members pivot.

5. The refrigerator according to claim 4, wherein the handle link is connected to a center of the second link.

6. The refrigerator according to claim 1, wherein each of the guide slots further comprises a support groove provided at a rear end of the guide slot while having a lower level than a remaining portion of the guide slot, to support a corresponding one of the handle members in order retain a raised position of the shelf.

7. The refrigerator according to claim 6, wherein each of the guide members comprises a pair of stopper ribs to support the cam members corresponding to the guide member, when the shelf is positioned a lowered position thereof.

8. The refrigerator according to claim 7, wherein the stopper ribs protrude from formed at the outer surface of the guide member while being vertically elongated, to support front surfaces of the cam members, respectively.

9. The refrigerator according to claim 6, wherein each of the guide slots further comprises at least one intermediate groove having a lower level than a remaining portion of the guide slot, to retain the shelf at an intermediate level.

10. The refrigerator according to claim 1, wherein the guide members comprise:

a pair of side walls mounted in the storage chamber, to guide vertical movement of the shelf; and a rear wall connecting rear ends of the pair of side walls.

11. The refrigerator according to claim 1, wherein:

each of the guide members comprises a vertical guide groove formed at the outer surface of the guide member; and the shelf comprises a guide rib extending downwards from a lower surface of the shelf, the guide rib being fitted in the vertical guide groove, to be vertically slidable.

12. The refrigerator according to claim 11, wherein the guide rib is spaced from an outer surface of a corresponding one of the side walls in the shelf by a predetermined distance.

13. The refrigerator according to claim 1, wherein the shelf comprises:

a peripheral portion; and a shelf portion mounted to the peripheral portion inside the peripheral portion and made of a transparent material.

14. A refrigerator comprising:

a cabinet having a storage chamber therein; and at least one movable shelf configured to move vertically and provided in the storage chamber, wherein the movable shelf includes at least one flat panel, first and second lateral walls extending vertically from ends of the at least one flat panel, first and second guide supports configured to be coupled to in the storage chamber, the first guide support coupled to a first side wall of the storage chamber and the second guide support coupled to a second side wall of the storage chamber, the first and second lateral walls configured to be guided in vertical movement by the first and second guide supports, respectively, a first guide slot provided on the first guide support and extending in a horizontal direction, a pair of first cams configured to pivot over a first side surface of the first guide support to move the flat panel vertically, at least one first coupling link to link the pair of first cams to allow simultaneous pivoting of the pair of first cams, a first movable link coupled to the at least one coupling link, wherein when one end of the first movable link is move in a horizontal direction along the first guide slot, the flat panel is raised in a vertical direction based on pivot rotation of the pair of first cams.

15. The refrigerator of claim 14, wherein the movable shelf further comprises:

a pair of second cams configured to pivot over a first surface of the second guide support; and at least one second coupling link to link the pair of second cams.

16. The refrigerator of claim 15, wherein the movable shelf further comprises:

a second guide slot provided on the second guide support and extending in a horizontal direction; and a second movable link having a second end configured to move in a horizontal direction along the second guide slot.

17. The refrigerator of claim 16, wherein the first side surfaces of the first and second guide supports are outer surfaces facing first and second walls of the storage chamber, and first and second walls being opposing walls facing each other.

18. The refrigerator of claim 17, wherein the movable shelf further comprises at least one handle provided on at least one of first end of the first movable link or the second end of the second movable link, the at least one handle extending through at least one of the first guide slot or the second guide slot.

19. The refrigerator of claim 16, wherein each camber member of the pairs of first and second cam members has a dwell angle of substantially 90 degrees.

20. The refrigerator of claim 16, when the flat panel is in a raised position, a rounded corner of each of the first and second cams support the flat panel.

* * * * *